United States Patent [19]

Wagener

[11] Patent Number: 4,538,879

[45] Date of Patent: Sep. 3, 1985

[54] MOVABLE FUSE SOCKET SUPPORT FOR USE ON BUS BARS

[75] Inventor: Hans Wagener, Dietzholztal, Fed. Rep. of Germany

[73] Assignee: Rittal-Werk Rudolf Loh GmbH & Co. KG, Fed. Rep. of Germany

[21] Appl. No.: 589,892

[22] Filed: Mar. 15, 1984

[30] Foreign Application Priority Data

Mar. 16, 1983 [DE] Fed. Rep. of Germany ..... 3309360
Jan. 12, 1984 [DE] Fed. Rep. of Germany ..... 3400805

[51] Int. Cl.[3] ..... H01R 13/60; H01R 4/30

[52] U.S. Cl. ..... 339/22 B; 339/198 N; 339/264 R

[58] Field of Search ..... 339/22 B, 198 N, 242, 339/264 R, 264 L

[56] References Cited

U.S. PATENT DOCUMENTS

| | | | |
|---|---|---|---|
| 3,694,701 | 9/1972 | Stanback | 339/198 N |
| 3,727,171 | 4/1973 | Coles et al. | 339/22 B |
| 4,220,392 | 9/1980 | Debaigt | 339/198 N |
| 4,222,627 | 9/1980 | Cox et al. | 339/198 N |
| 4,231,633 | 11/1980 | Luke et al. | 339/242 |

FOREIGN PATENT DOCUMENTS 2151641 4/1973 Fed. Rep. of Germany .

*Primary Examiner*—Gil Weidenfeld
*Assistant Examiner*—Gary F. Paumen
*Attorney, Agent, or Firm*—Thomas W. Speckman

[57] ABSTRACT

A movable fuse socket support including a fuse holder which is adapted to be attached to bus bars is provided on the underside of a socket plate with fastening means which cooperate with the bus bar to establish a firm connection between a separate contact plate covering the underside of the fuse holder and the bus bar. The fuse of universal contact plates suitable both for the gauge ring system and the gauge screw system is achieved in that the contact plate has a tapped bore coinciding with the center axis of the fuse holder, that adjacent the fuse holder the underside of the socket plate has a recess in which is disposed a C-shaped clamp including a setscrew which is adjustable from the uppersdie of the socket plate, that the C-shaped clamp embraces one end of the contact plate together with the bus bar which is in abutting relationship with the underside of the contact plate, that the opposite end of the contact plate is inserted into a groove provided in the socket plate and is retained therein, and that a setscrew tightens the contact plate and the bus bar relative to each other and against the lower arm of the C-shaped clamp.

23 Claims, 5 Drawing Figures

MOVABLE FUSE SOCKET SUPPORT FOR USE ON BUS BARS

BACKGROUND OF THE INVENTION

1. Field of the Invention

This invention relates to a movable fuse socket support which is adapted to be attached to bus bars. The movable fuse socket support is provided on the underside of its socket plate, which includes a fuse holder, with fastening means cooperating with the bus bar, by which fastening means firm contact is established between a separate contact plate which covers the underside of the fuse holder and the bus bar.

2. Description of the Prior Art

Fuse socket supports are available in two systems. One is the so called Diazed system, and the other is a system alternatively called DO, Dezero or Neozed system. Both systems accommodate fuses of different current ratings. To prevent a fuse of an incorrect rating from being inserted, for instance, a high rating fuse from being inadvertently inserted into a low amperage circuit, a gauge ring is used according to the DO system. The gauge ring is de-energized and functions to accommodate the fuses of the proper rating according to their diameters. In a gauge ring system, the fuse is directly attached to the base contact or, as in the present case, to the current carrying bus bar.

In the Diazed system, a gauge or sizing screw is used to ensure proper selection of fuses. The gauge screw is likewise fuse diameter oriented to the diameter of the base contact, but it also functions as the electrical connection to the base contact of the element, or to the current carrying bus bar. This system requires that the bus bar have threaded bores, or it requires an adapter as an additional connecting member between gauge screw and bus bar.

A movable fuse socket support of the foregoing type is known from German Patent Publication OS No. 21 51 641. In this prior movable fuse socket support, the contact plate has an offset section for a tapped bore to receive a gauge screw. The contact plate and the offset section conform to a specific thickness of the bus bar, so that bus bars of different thicknesses require different contact plates. This is because the bus bar is held on the contact plate by a clip which is rotatably mounted on one side of the socket plate. This results in the further disadvantage that when the movable fuse socket support is detached from the bus bar, at least one screw tightening the side of the clip not attached to the socket plate must be removed. To allow for manufacturing tolerances, the clip must be able to flex so as to achieve sufficient tightening and this leads to permanent deformation of the clip. Moreover, the prior movable fuse socket support is suitable for gauge screw systems only. To use it in connection with gauge ring systems, an additional set of contact plates would be required.

SUMMARY OF THE INVENTION

It is an object of the present invention to provide a movable fuse socket support including a uniquely formed contact plate which renders the fuse support suitable for use in connection with both gauge ring systems and gauge screw systems, and which movable fuse socket support in any case is adapted to be firmly connected over a large contact area to bus bars having different thicknesses and widths.

This object is achieved according to this invention in that the contact plate has a threaded bore coinciding with the center axis of the fuse holder, that adjacent the fuse holder the underside of the socket plate is provided with a recess in which is disposed a C-shaped clamp and a setscrew which is adjustable from the upperside of the socket plate, that the C-shaped clamp embraces one end of the contact plate along with the bus bar which is in abutting contact with the underside of the contact plate, that the opposite end of the contact plate is inserted into a groove in the socket plate and is retained therein, and that the setscrew tightens the contact plate and the bus bar relative to each other within the C-shaped clamp.

Gauge rings which bear against the contact plate may be inserted in the fuse holder. Gauge screws may be threadedly inserted into the threaded bore provided in the contact plate. The electrical contact is established between the fuse and the contact plate so that it is merely necessary to replace the contact plate in the event of failure of the screw threads being sufficiently tightened in the fuse holder, resulting in burning or charring. The connection between the C-shaped clamp, the bus bar and the contact plate is firm and over a large contact area, and is independent of the thickness of the bus bar as long as it does not exceed a predetermined value. Thus, the movable fuse socket support is universally usable and yet is easy to detach from the bus bar, which is important for removing, mounting, and replacing the contact plate. The movable fuse socket support of this embodiment retains the advantage of the prior art fuse support, namely, that fuses are not in direct contact with the bus bar, but, in addition, has the advantage that this movable fuse socket support is suitable for use on bus bars of different thicknesses by virtue of the unique construction of the contact plate and is adaptable for use in connection with gauge ring systems as well as gauge screw systems.

According to another embodiment, the contact plate is adapted to be detachably mounted on the socket plate so that the contact plate, upon loosening of the setscrew, can be easily replaced.

According to another embodiment, a groove to receive the contact plate is formed in the socket plate at the underside of the fuse holder and is limited by a projection of the socket plate.

To adjust the C-shaped clamp in the recess of the socket plate, according to another embodiment, the recess is rectangular in shape and is adapted to hold the C-shaped clamp in a non-rotatable manner, the setscrew is threadedly inserted in a tapped bore provided in the upper arm of the C-shaped clamp which faces the underside of the socket plate, the lower arm of the C-shaped clamp is provided with claws on its side facing the bus bar, and the setscrew, having a screw head and being threadedly inserted into the tapped bore in the upper arm of the C-shaped clamp, is securely retained in a bore provided in the socket plate which forms a closure for the recess.

To enable the movable fuse socket support to be used with bus bars of different thicknesses and widths, another embodiment provides that the clearance between the upper and lower arms of the C-shaped clamp corresponds to at least the sum of the thickness of the contact plate and the maximum thickness of the bus bar, and that the distance between the projection and the groove for receiving the contact plate, and the side of the contact plate embraced by the C-shaped clamp, is in excess of the maximum width of the bus bar by a predetermined amount to permit insertion of the bus bar into the clamp.

Normally, the movable fuse socket support accommodates a single fuse. According to another embodiment, however, the socket plate is provided with more than one fuse holder, each fuse holder having a separate contact plate and a separate C-shaped clamp.

Mounting the contact plate and the C-shaped clamp is simplified according to another embodiment, in that the end portion of the setscrew inserted into a tapped bore in the upper arm of the C-shaped clamp and facing the contact plate, is securely retained but freely rotatable in the contact plate, and that the contact plate positioned in the groove in the socket plate is additionally secured to the underside of the socket plate by a fastening screw.

In this embodiment, the contact plate, the C-shaped clamp and the setscrew form an integral prefabricated unit which can be quickly and easily attached to, and detached from, the socket plate by means of the additional fastening screw. The setscrew may be turned counterclockwise into a withdrawn position, but it will not become detached from the clamp and the contact plate. In a similar manner, the movable fuse socket support can be conveniently attached to, and detached from, the bus bar.

The component parts will not come loose from the socket plate, unless the complete unit comprising the contact plate, the C-shaped clamp and the setscrew, is replaced after removal of the movable fuse socket support from the bus bar. Removal is accomplished by removing the fastening screw connection between the contact plate and the socket plate.

The retentive but freely rotatable attachment of the setscrew to the contact plate is achieved according to another embodiment in that the end portion of the setscrew has a reduced diameter which is inserted into an aperture in the contact plate which tapers conically toward the setscrew and wherein the end portion is formed so that an axially non-displaceable, but freely rotatable mounting of the setscrew is achieved.

The connection between the socket plate and the contact plate is established according to another embodiment in that the socket plate is provided with a closed tapped bore on the underside, between the fuse holder and the recess for the C-shaped clamp, and that the contact plate is provided in the region of this closed tapped bore with a receptacle for the countersunk head of the fastening screw, which receptacle is conically tapering toward the socket plate. In this way, the fastening screw is flush providing abutting contact between the bus bar and the underside of the contact plate.

The insertion of the contact plate into the groove of the socket plate may be facilitated for the unit comprising the contact plate, the C-shaped clamp and the setscrew, by providing that the wall of the recess facing the end of the contact plate embraced by the C-shaped clamp is spaced a predetermined distance from the clamp after the contact plate has been inserted into the groove and has been screwed to the socket plate. In addition, the recess merges on the upperside of the socket plate into a protective housing enclosing the head of the setscrew, providing sufficient clearance for adjustment. Thus, the setscrew is capable of the necessary adjustment motion within the protective housing, as the contact plate is inserted into the groove in the socket plate, and remains adjustable from the upperside of the socket plate.

The application of the contact plate to the socket plate and its bearing against it may be further improved according to another embodiment in that the wall of the recess facing the end of the contact plate embraced by the C-shaped clamp is provided with a shoulder section against which an end of the contact plate extending through the clamp is braced.

BRIEF DESCRIPTION OF THE DRAWINGS

Further objects, advantages and features of the present invention will appear from the following description of illustrative embodiments taken with the accompanying drawings, in which.

DESCRIPTION OF THE PREFERRED EMBODIMENTS

Figure 1:
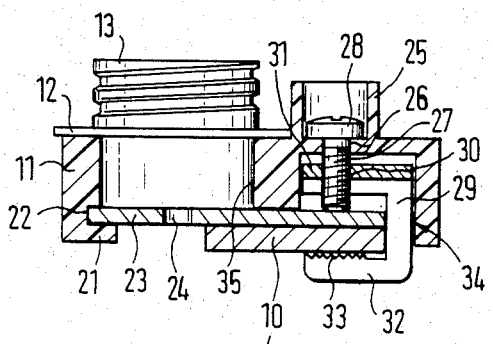
FIG. 1 is a side sectional view of the movable fuse socket support attached to the bus bar, taken along the line I—I of FIG. 2.
Figure 2:
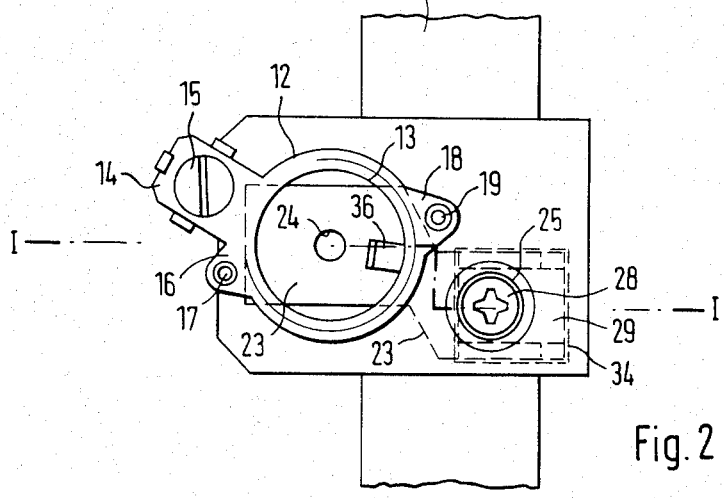
FIG. 2 is a top view of the movable fuse socket support attached to the bus bar, according to FIG. 1.

Referring to FIGS. 1 and 2, the movable fuse socket support comprises socket plate 11 made of an insulating material and having fuse holder 35 extending therein. Disposed on the upperside of socket plate 11 and centered with respect to fuse holder 35 is threaded portion 13. Threaded portion 13 of fuse holder 35 is fastened on socket plate 11 by means of flanges 16 and 18 which are fastened to socket plate 11 by rivets 17 and 19. Projecting from rim 12 are flanges 16 and 18, and terminal lug 14 with terminal screw 15 for an electrical conductor.

Adjacent fuse holder 35, socket plate 11 is provided with recess 34 open from below. Recess 34 is inverted cup-shaped and its closed end is defined by the upper portion of socket plate 11 which has through bore 26 therein to receive setscrew 27 having screw head 28. Setscrew 27 extends through bore 26 and is screwed into tapped bore 30 provided in upper arm 31 of C-shaped clamp 29. Setscrew 27 and C-shaped clamp 29 are securely retained on socket plate 11 because screw head 28 serves to retain socket plate 11. C-shaped clamp 29 is adjustable within recess 34 by means of setscrew 27. Screw head 28 of setscrew 27 is protected by protective housing 25 formed on the upperside of socket plate 11. Protective housing 25 may be closed by a plug or the like so as to render screw head 28 of setscrew 27 inaccessible.

Contact plate 23 has threaded bore 24 in the area of the center axis of fuse holder 35. Extending into fuse holder 35 is spring 36 for holding gauge rings. Contact plate 23 extends across recess 34 and into C-shaped clamp 29. On the opposite side, contact plate 23 is retained in goove 22 bordered by projection 21 of socket plate 11. Thus, contact plate 13 is detachably fastened to the underside of socket plate 11 and may be easily replaced.

C-shaped clamp 29 also holds bus bar 10 in a firm contacting relationship with the underside of contact plate 23. Between setscrew 27 and lower arm 32 of C-shaped clamp 29, contact plate 23 and bus bar 10 are tightly clamped together. The space between upper arm 31 and lower arm 32 of C-shaped clamp 29 is at least equal to the sum of the thickness of contact plate 23 and the maximum thickness of bus bar 10 so that a movable fuse socket support of this particular type is suitable for use on bus bars of different thicknesses.

To enable the movable fuse socket support to be used also on bus bars of different widths, the distance between the opposite ends of contact plate 23, one end of which is held in groove 22 and the other end in the C-shaped clamp 29, is greater by a predetermined measure than the maximum width of bus bar 10. The predetermined measure is such that bus bar 10 may be inserted into C-shaped clamp 29. Lower arm 32 of C-shaped clamp 29 forms a bearing surface for bus bar 10 and is provided on the side facing bus bar 10 with claws 33 or the like to ensure good contact as the assembly is tightened.

Fuse holder 35 may be adapted to receive either gauge rings or gauge screws. If screws, or pins, are used, they are threadedly inserted into threaded bore 24 and are thus secured on contact plate 23. In no case is contact established directly between the inserted fuse and bus bar 10. If screw threads on threaded portion 13 are not sufficiently tight, a loose contact between the fuse and contact plate 23 will result. A charred contact plate 23 can be replaced easily, and there is no need to detach the structural elements secured to bus bar 10.

Figure 3:
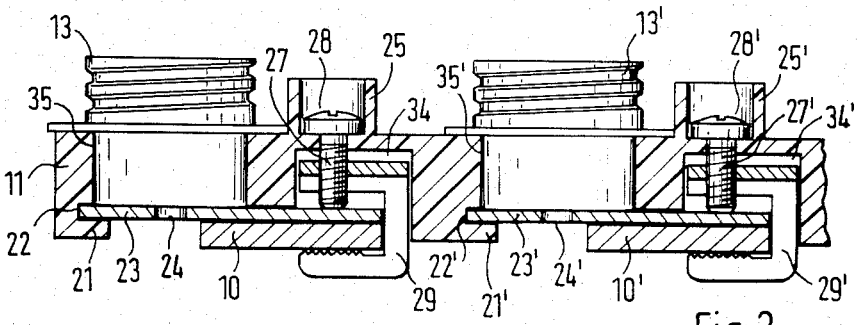
FIG. 3 is a side sectional view of a fuse socket support with two fuse elements positioned adjacent to one another.

As shown in FIG. 3, socket plate 11 may contain more than one fuse holder, such as 35 and 35'. Each fuse holder 35 and 35' has a corresponding threaded member 13 and 13', contact plate 23 and 23', C-shaped clamp 29 and 29', setscrew 27 and 27' with screw head 28 and 28', respectively. Contact plates 23, 23' are detachably held in grooves 22, 22' limited by projections 21, 21', on the underside of socket plate 11. C-shaped clamps 29, 29' are adjustable in recesses 34, 34', respectively, to hold contact plates 23, 23' in close abutting contact with parallel bus bars 10, 10'. The positioning of setscrews 27, 27' and the center axes of fuse holders 35, 35' is dependent upon the distance between the center axes of bus bars 10, 10'. Thus, socket plate 11 may be constructed to hold multiple fuses. It will be appreciated that socket plate 11 may also be constructed to hold two or more fuses positioned adjacent each other in the longitudinal direction of bus bar 10.

Figure 4:
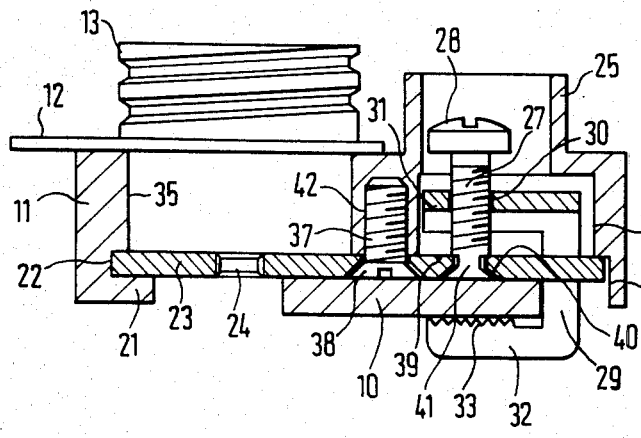
FIG. 4 is a side sectional view of another embodiment of a movable fuse socket support attached to the bus bar.
Figure 5:
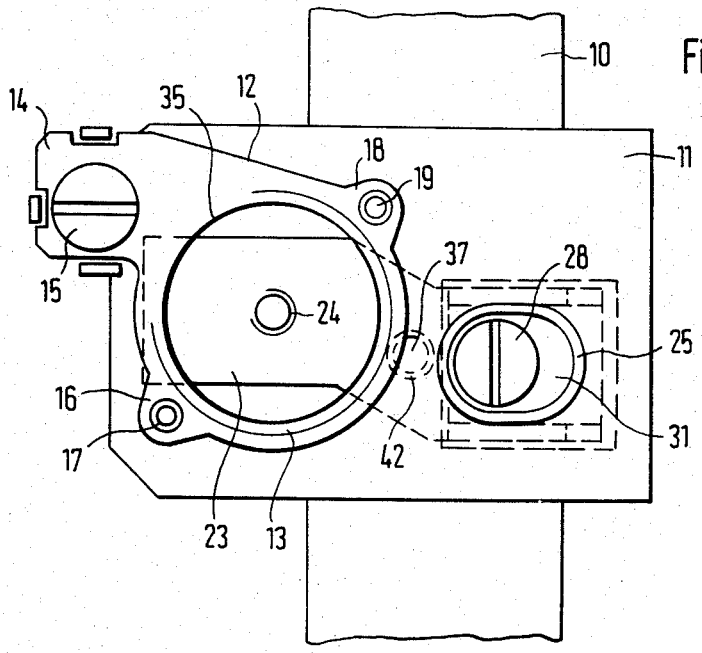
FIG. 5 is a top view of the movable fuse socket support of FIG. 4 attached to the bus bar.

The movable fuse socket support according to FIGS. 4 and 5 comprises socket plate 11 made of an insulating material and having fuse holder 35 extending therethrough. Disposed on the upperside of socket plate 11 and centered with respect to fuse holder 35 is threaded portion 13. It is fastened on socket plate 11 by means of flanges 16 and 18 which are joined to socket plate 11 by rivets 17 and 19. Projecting from rim 12 are flanges 16 and 18, and terminal lug 14 with terminal screw 15 for an electrical conductor.

Adjacent fuse holder 35, socket plate 11 is provided with rectangular or square recess 34 accessible from below. On the upperside of socket plate 11, recess 34 merges into protective housing 25.

At the center axis of fuse holder 35, contact plate 23 is provided with threaded bore 24 for receiving a gauge screw.

Set screw 27, which is screwed into tapped bore 30 in upper arm 32 of C-shaped clamp 29, terminates at the end facing contact plate 23 in an end portion 41 having a reduced diameter. This end portion 41 of setscrew 27 is axially immovable but is freely rotatable in aperture 40 of contact plate 23. Aperture 40 tapers toward setscrew 27, and end portion 41 of setscrew 27 is shaped such that it conforms to the configuration of aperture 40. In this way, C-shaped clamp 29, setscrew 27 and contact plate 23 combine to form a unit which can be prefabricated and can be attached as a whole to socket plate 11 and, conversely, can be easily detached from it.

Detachable mounting of the unit comprising contact plate 23, C-shaped clamp 29 and setscrew 27 on socket plate 11 is effected by fastening screw 37. Fastening screw 37 is inserted in blind tapped bore 42 located between fuse holder 35 and recess 34 on the underside of fuse block 11, and its countersunk head 38 is retained in receptacle 39 provided in contact plate 23. Countersunk head 38 of fastening screw 37 is flush with the underside of contact plate 23 so that it poses no obstacle when bus bar 10 is placed in abutting contact with the underside of contact plate 23.

Contact plate 23 is slidably inserted into groove 22 below fuse holder 35. Groove 22 is limited on one side by projection 21 of socket plate 11. As contact plate 23 is being inserted into groove 22, C-shaped clamp 29 is simultaneously inserted into recess 34, so that it is necessary for recess 34 to be sized to permit the required movement of contact plate 23. The wall of recess 34 facing the end of contact plate 23 which is embraced by C-shaped clamp 29 is, in the mounted condition, at a predetermined distance from the end of contact plate 23 and C-shaped clamp 29, which corresponds to the path of movement of contact plate 23 for insertion into groove 22. The same amount of movement or spacing must be provided for screw head 28 of setscrew 27 in the protective housing 25.

Lower arm 32 of C-shaped clamp 29 is provided with claws 33 and bears against the underside of bus bar 10. As setscrew 27 is tightened, good contact is established between contact plate 23 and bus bar 10, and between bus bar 10 and lower arm 32 of C-shaped clamp 29. Loosening of setscrew 27 is limited by contact plate 23 abutting against upper arm 31 of C-shaped clamp 29. The movable fuse socket support can then be laterally withdrawn from bus bar 10, and the unit comprising contact plate 23, C-shaped clamp 29 and setscrew 27 is retained on socket plate 11. This unit may be readily replaced simply by loosening fastening screw 37.

In the embodiment illustrated in FIG. 4, contact plate 23 extends through C-shaped clamp 29 and bears against socket plate 11. For this purpose, the wall of recess 34 facing this end of contact plate 23 is provided with shoulder section 43 against which contact plate 23 is braced as fastening screw 37 is tightened. Setscrew 27 including screw head 28 can be adjusted from the top of socket plate 11 through protective housing 25.

I claim:

1. A movable fuse socket support adapted to be attached to bus bars comprises a socket plate which includes a fuse holder and is provided on its underside with fastening means which cooperate with said bus bar and establish good contact between a separate contact plate covering the underside of said fuse holder and said bus bar, characterized in that said contact plate (23) has a threaded bore (24) coinciding with the center axis of said fuse holder (35), that adjacent said fuse holder (35) on said underside of said socket plate (11) a recess (34) is provided in which is disposed C-shaped clamp (29) with setscrew (27) threadedly engaged in a tapped bore (30) on the upper arm of said C-shaped clamp (29) adjustable from the upperside of said socket plate (11), that said C-shaped clamp (29) embraces one end of said contact plate (23) together with said bus bar (10) and establishes abutting contact between the underside of said contact plate (23) and the upperside of said bus bar (10), that the opposite end of said contact plate (23) is retained in groove (22) provided in said socket plate (11), and that said setscrew (27) is adjustable to tighten said contact plate (23) and said bus bar (10) relative to each other and against the lower arm of said C-shaped clamp (29).

2. A movable fuse socket support according to claim 1, characterized in that said contact plate (23) is detachably mounted on said socket plate (11).

3. A movable fuse socket support according to claim 1, characterized in that said groove (22) is formed at the underside of said fuse holder (35) and is limited by projection (21) of said socket plate (11).

4. A movable fuse socket support according to claim 3, characterized in that said recess (34) is rectangular in shape and is adapted to hold said C-shaped clamp (29) in a non-rotatable manner, that said setscrew (27) is adjustable in tapped bore (30) provided in upper arm (31) of said C-shaped clamp (29) which faces said underside of said socket plate (11), that lower arm (32) of said C-shaped clamp (29) is provided with claws (33), and that said setscrew (27) having screw head (28) and being threadedly inserted into said tapped bore (30) of said C-shaped clamp (29) is securely retained in bore (26) provided in said underside of said socket plate (11) which defines said recess (34).

5. A movable fuse socket support according to claim 4, characterized in that the clearance between said upper arm (31) and said lower arm (32) of said C-shaped clamp (29) corresponds to at least the sum of the thickness of said contact plate (23) and the maximum thickness of said bus bar (10).

6. A movable fuse socket support according to claim 5, characterized in that the distance between said projection (21) limiting said groove (22) receiving said contact plate (23) and said end of said contact plate (23) embraced by said C-shaped clamp (29) is greater than the maximum width of said bus bar (10) by a predetermined amount to permit insertion of said bus bar (10) into said C-shaped clamp (29).

7. A movable fuse socket support according to claim 6, characterized in that said socket plate (11) carries a plurality of said fuse holders, each said fuse holder (35, 35') having separate said contact plates (23, 23') and separate said C-shaped clamps (29, 29').

8. A movable fuse socket support according to claim 7, characterized in that end portion (41) of said setscrew (27) threadedly inserted into said tapped bore (10) provided in said upper arm (31) of said C-shaped clamp (29) and facing said contact plate (23) is securely retained but freely rotatable in said contact plate (23), and that said contact plate (23) inserted into said groove (22) in said socket plate (11) is additionally secured to said underside of said socket plate (11) by fastening screw (37).

9. A movable fuse socket support according to claim 8, characterized in that said end portion (41) of said setscrew (27) having a reduced diameter is inserted into aperture (40) in said contact plate (23) which tapers toward said setscrew (27) and where said end portion (41) is formed to achieve an axially non-displaceable but rotatable mounting of said setscrew (27).

10. A movable fuse socket support according to claim 9, characterized in that said socket plate (11) is provided on said underside with closed tapped bore (42) disposed between said fuse holder (35) and said recess (34) for said C-shaped clamp (29), and that said contact plate (23) is provided in the region of said closed tapped bore (42) with receptacle (39) for countersunk head (38) of said fastening screw (37), said receptacle (39) conically tapering toward said socket plate (11).

11. A movable fuse socket support according to claim 10, characterized in that the wall of said recess (34) facing said end of said contact plate (23) embraced by said C-shaped clamp (29) is disposed a predetermined distance from said C-shaped clamp (29) when said contact plate (23) is inserted in said groove (22) and screwed to said socket plate (11).

12. A movable fuse socket support according to claim 11, characterized in that said wall of said recess (34) is provided with shoulder section (43) against which said edge of said contact plate (23) extending through said C-shaped clamp (29) is braced.

13. A movable fuse socket support according to claim 8, characterized in that said recess (34) merges into protective housing (25) provided on said upperside of said socket plate (11) which encloses said screw head (28) of said setscrew (27) and provides sufficient clearance for adjustment of said setscrew 27.

14. A movable fuse socket support according to claim 1, characterized in that said recess (34) is rectangular in shape and is adapted to hold said C-shaped clamp (29) in a non-rotatable manner, that said setscrew (27) is adjustable in tapped bore (30) provided in upper arm (31) of said C-shaped clamp (29) which faces said underside of said socket plate (11), that lower arm (32) of said C-shaped clamp (29) is provided with claws (33), and that said setscrew (27) having screw head (28) and being threadedly inserted into said tapped bore (30) of said C-shaped clamp (29) is securely retained in bore (26) provided in said underside of said socket plate (11) which defines said recess (34).

15. A movable fuse socket support according to claim 1, characterized in that the clearance between said upper arm (31) and said lower arm (32) of said C-shaped clamp (29) corresponds to at least the sum of the thickness of said contact plate (23) and the maximum thickness of said bus bar (10).

16. A movable fuse socket support according to claim 3, characterized in that the distance between said projection (21) limiting said groove (22) receiving said contact plate (23) and said end of said contact plate (23) embraced by said C-shaped clamp (29) is greater than the maximum width of said bus bar (10) by a predetermined amount to permit insertion of said bus bar (10) into said C-shaped clamp (29).

17. A movable fuse socket support according to claim 1, characterized in that said socket plate (11) carries a plurality of said fuse holders, each said fuse holder (35, 35') having separate said contact plates (23, 23') and separate said C-shaped clamps (29, 29').

18. A movable fuse socket support according to claim 1, characterized in that end portion (41) of said setscrew (27) threadedly inserted into said tapped bore (10) provided in said upper arm (31) of said C-shaped clamp (29) and facing said contact plate (23) is securely retained but freely rotatable in said contact plate (23), and that said contact plate (23) inserted into said groove (22) in said socket plate (11) is additionally secured to said underside of said socket plate (11) by fastening screw (37).

19. A movable fuse socket support according to claim 18, characterized in that said end portion (41) of said setscrew (27) having a reduced diameter is inserted into aperture (40) in said contact plate (23) which tapers toward said setscrew (27) and where said end portion (41) is formed to achieve an axially non-displaceable but rotatable mounting of said setscrew (27).

20. A movable fuse socket support according to claim 18, characterized in that said socket plate (11) is provided on said underside with closed tapped bore (42) disposed between said fuse holder (35) and said recess (34) for said C-shaped clamp (29), and that said contact plate (23) is provided in the region of said closed tapped bore (42) with receptacle (39) for countersunk head (38) of said fastening screw (37), said receptacle (39) conically tapering toward said socket plate (11).

21. A movable fuse socket support according to claim 18, characterized in that the wall of said recess (34) facing said end of said contact plate (23) embraced by said C-shaped clamp (29) is disposed a predetermined distance from said C-shaped clamp (29) when said contact plate (23) is inserted in said groove (22) and screwed to said socket plate (11).

22. A movable fuse socket support according to claim 21, characterized in that said wall of said recess (34) is provided with shoulder section (43) against which said edge of said contact plate (23) extending through said C-shaped clamp (29) is braced.

23. A movable fuse socket support according to claim 18, characterized in that said recess (34) merges into protective housing (25) provided on said upperside of said socket plate (11) which encloses said screw head (28) of said setscrew (27) and provides sufficient clearance for adjustment of said setscrew 27.

* * * * *